US008270639B2

(12) United States Patent
Jiang et al.

(10) Patent No.: US 8,270,639 B2
(45) Date of Patent: Sep. 18, 2012

(54) THERMOACOUSTIC DEVICE

(75) Inventors: Kai-Li Jiang, Beijing (CN); Liang Liu, Beijing (CN); Chen Feng, Beijing (CN); Li Qian, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/655,502

(22) Filed: Dec. 31, 2009

(65) Prior Publication Data

US 2010/0110839 A1 May 6, 2010

Related U.S. Application Data

(63) Continuation-in-part of application No. 12/387,089, filed on Apr. 28, 2009, now Pat. No. 8,068,624.

(30) Foreign Application Priority Data

| | | |
|---|---|---|
| Apr. 28, 2008 | (CN) | 2008 1 0066693 |
| Jun. 4, 2008 | (CN) | 2008 1 0067586 |
| Jun. 4, 2008 | (CN) | 2008 1 0067589 |
| Jun. 4, 2008 | (CN) | 2008 1 0067638 |
| Jun. 18, 2008 | (CN) | 2008 1 0067905 |
| Jun. 18, 2008 | (CN) | 2008 1 0067906 |
| Jun. 18, 2008 | (CN) | 2008 1 0067907 |
| Jun. 18, 2008 | (CN) | 2008 1 0067908 |
| Dec. 5, 2008 | (CN) | 2008 1 0218230 |
| Feb. 27, 2009 | (CN) | 2009 1 0105808 |
| Mar. 31, 2009 | (CN) | 2009 1 0106493 |

(51) Int. Cl.
*H04R 25/00* (2006.01)

(52) U.S. Cl. ..... 381/164; 398/132; 398/133; 398/134; 398/156

(58) Field of Classification Search ..... 381/164; 398/132–134, 168
See application file for complete search history.

(56) References Cited

U.S. PATENT DOCUMENTS

| | | | | |
|---|---|---|---|---|
| 1,526,778 A | * | 2/1925 | De Forest | 381/164 |
| 1,528,774 A | | 3/1925 | Kranz | |
| 4,002,897 A | | 1/1977 | Kleinman et al. | |
| 4,310,731 A | * | 1/1982 | Carlsen, II | 381/164 |
| 4,334,321 A | | 6/1982 | Edelman | |
| 4,503,564 A | * | 3/1985 | Edelman et al. | 398/132 |
| 4,641,377 A | | 2/1987 | Rush et al. | |

(Continued)

FOREIGN PATENT DOCUMENTS

CN 2302622 12/1998

(Continued)

OTHER PUBLICATIONS

Lin Xiao, Zhuo Chen, Chen Feng, Liang Liu et al., Flexible, Stretchable, Transparent Carbon Nanotube Thin Film Loudspeakers, Nano Letters, 2008, pp. 4539-4545, vol. 8, No. 12, US.

(Continued)

*Primary Examiner* — Curtis Kuntz
*Assistant Examiner* — Ryan Robinson
(74) *Attorney, Agent, or Firm* — Altis Law Group, Inc.

(57) ABSTRACT

A thermoacoustic device includes a sound wave generator and an infra-red reflecting element having an infrared reflection coefficient higher than 30 percent. The infra-red reflecting element can be disposed at one side of the sound wave generator to reflect the emitted heat of the sound wave generator.

19 Claims, 9 Drawing Sheets

U.S. PATENT DOCUMENTS

| | | | | |
|---|---|---|---|---|
| 4,766,607 | A | 8/1988 | Feldman | |
| 5,694,477 | A * | 12/1997 | Kole | 381/111 |
| 6,473,625 | B1 | 10/2002 | Williams et al. | |
| 6,777,637 | B2 | 8/2004 | Nakayama et al. | |
| 6,803,116 | B2 | 10/2004 | Ikeda | |
| 6,808,746 | B1 | 10/2004 | Dai et al. | |
| 6,839,439 | B2 * | 1/2005 | Daly | 381/71.5 |
| 6,921,575 | B2 | 7/2005 | Horiuchi et al. | |
| 7,045,108 | B2 | 5/2006 | Jiang et al. | |
| 7,393,428 | B2 | 7/2008 | Huang et al. | |
| 7,474,590 | B2 | 1/2009 | Watabe et al. | |
| 7,723,684 | B1 | 5/2010 | Haddon et al. | |
| 7,799,163 | B1 | 9/2010 | Mau et al. | |
| 2001/0005272 | A1 | 6/2001 | Buchholz | |
| 2001/0048256 | A1 | 12/2001 | Miyazaki et al. | |
| 2002/0076070 | A1 | 6/2002 | Yoshikawa et al. | |
| 2003/0038925 | A1 | 2/2003 | Choi | |
| 2003/0165249 | A1 | 9/2003 | Higuchi | |
| 2004/0053780 | A1 | 3/2004 | Jiang et al. | |
| 2005/0040371 | A1 | 2/2005 | Watanabe et al. | |
| 2005/0201575 | A1 * | 9/2005 | Koshida et al. | 381/164 |
| 2006/0072770 | A1 | 4/2006 | Miyazaki | |
| 2006/0104451 | A1 * | 5/2006 | Browning et al. | 381/59 |
| 2006/0147081 | A1 | 7/2006 | Mango, III et al. | |
| 2006/0264717 | A1 | 11/2006 | Pesach et al. | |
| 2007/0145335 | A1 | 6/2007 | Anazawa | |
| 2007/0164632 | A1 | 7/2007 | Adachi et al. | |
| 2007/0166223 | A1 | 7/2007 | Jiang et al. | |
| 2007/0176498 | A1 | 8/2007 | Sugiura et al. | |
| 2008/0063860 | A1 | 3/2008 | Song et al. | |
| 2008/0095694 | A1 | 4/2008 | Nakayama et al. | |
| 2008/0170982 | A1 * | 7/2008 | Zhang et al. | 423/447.3 |
| 2008/0248235 | A1 | 10/2008 | Feng et al. | |
| 2008/0260188 | A1 | 10/2008 | Kim | |
| 2008/0299031 | A1 | 12/2008 | Liu et al. | |
| 2009/0016951 | A1 | 1/2009 | Kawabata et al. | |
| 2009/0028002 | A1 | 1/2009 | Sugiura et al. | |
| 2009/0045005 | A1 | 2/2009 | Byon et al. | |
| 2009/0085461 | A1 | 4/2009 | Feng et al. | |
| 2009/0096346 | A1 | 4/2009 | Liu et al. | |
| 2009/0096348 | A1 | 4/2009 | Liu et al. | |
| 2009/0145686 | A1 | 6/2009 | Watabe et al. | |
| 2009/0153012 | A1 | 6/2009 | Liu et al. | |
| 2009/0167136 | A1 | 7/2009 | Liu et al. | |
| 2009/0167137 | A1 | 7/2009 | Liu et al. | |
| 2009/0196981 | A1 | 8/2009 | Liu et al. | |
| 2009/0232336 | A1 | 9/2009 | Pahl | |
| 2010/0054502 | A1 | 3/2010 | Miyachi | |
| 2010/0054507 | A1 | 3/2010 | Oh et al. | |
| 2010/0086166 | A1 | 4/2010 | Jiang et al. | |
| 2010/0166232 | A1 | 7/2010 | Liu et al. | |
| 2010/0233472 | A1 | 9/2010 | Liu et al. | |
| 2011/0171419 | A1 | 7/2011 | Li et al. | |

FOREIGN PATENT DOCUMENTS

| | | |
|---|---|---|
| CN | 2425468 | 3/2001 |
| CN | 1407392 | 4/2003 |
| CN | 1443021 | 9/2003 |
| CN | 1698400 | 11/2005 |
| CN | 2779422 Y | 5/2006 |
| CN | 1787696 | 6/2006 |
| CN | 2787870 | 6/2006 |
| CN | 2798479 | 7/2006 |
| CN | 1821048 | 8/2006 |
| CN | 1886820 | 12/2006 |
| CN | 1944829 | 4/2007 |
| CN | 1982209 | 6/2007 |
| CN | 1997243 | 7/2007 |
| CN | 101239712 | 8/2008 |
| CN | 101284662 | 10/2008 |
| CN | 201150134 | 11/2008 |
| CN | 101314464 | 12/2008 |
| CN | 101471213 | 7/2009 |
| CN | 101715155 | 5/2010 |
| CN | 101400198 | 9/2010 |
| JP | 49-24593 | 3/1974 |
| JP | 58-9822 | 1/1983 |
| JP | 60-22900 | 2/1985 |
| JP | 1-255398 | 10/1989 |
| JP | 3-147497 | 6/1991 |
| JP | 4-126489 | 4/1992 |
| JP | 7-282961 | 10/1995 |
| JP | 9-105788 | 4/1997 |
| JP | 11-282473 | 10/1999 |
| JP | 11-300274 | 11/1999 |
| JP | 2001333493 | 11/2001 |
| JP | 2002-186097 | 6/2002 |
| JP | 2002-352940 | 12/2002 |
| JP | 2002346996 | 12/2002 |
| JP | 2002542136 | 12/2002 |
| JP | 2003500325 | 1/2003 |
| JP | 2003-154312 | 5/2003 |
| JP | 2003198281 | 7/2003 |
| JP | 2003-266399 | 9/2003 |
| JP | 2003-319490 | 11/2003 |
| JP | 2003-319491 | 11/2003 |
| JP | 2003-332266 | 11/2003 |
| JP | 20042103 | 1/2004 |
| JP | 2004-107196 | 4/2004 |
| JP | 2004229250 | 8/2004 |
| JP | 2005-20315 | 1/2005 |
| JP | 2005-51284 | 2/2005 |
| JP | 2005-73197 | 3/2005 |
| JP | 2005-97046 | 4/2005 |
| JP | 2005189322 | 7/2005 |
| JP | 2005-235672 | 9/2005 |
| JP | 2005-318040 | 11/2005 |
| JP | 2005-534515 | 11/2005 |
| JP | 2005-341554 | 12/2005 |
| JP | 2005333601 | 12/2005 |
| JP | 2006-93932 | 4/2006 |
| JP | 2006-180082 | 7/2006 |
| JP | 2006-202770 | 8/2006 |
| JP | 2006-217059 | 8/2006 |
| JP | 2006270041 | 10/2006 |
| JP | 2007-24688 | 2/2007 |
| JP | 2007-54831 | 3/2007 |
| JP | 2007-167118 | 7/2007 |
| JP | 2007-174220 | 7/2007 |
| JP | 2007-187976 | 7/2007 |
| JP | 2007-196195 | 8/2007 |
| JP | 2007-228299 | 9/2007 |
| JP | 2007-527099 | 9/2007 |
| JP | 2008-62644 | 3/2008 |
| JP | 2008-101910 | 5/2008 |
| JP | 2008-163535 | 7/2008 |
| JP | 2008-269914 | 11/2008 |
| JP | 2009-31031 | 2/2009 |
| JP | 2009-91239 | 4/2009 |
| JP | 2009-94074 | 4/2009 |
| JP | 2009-146896 | 7/2009 |
| JP | 2009-146898 | 7/2009 |
| JP | 2009-164125 | 7/2009 |
| JP | 2009-184907 | 8/2009 |
| JP | 2009-184908 | 8/2009 |
| KR | 10-0761548 | 9/2007 |
| TW | 200740976 | 11/2007 |
| TW | 200744399 | 12/2007 |
| TW | 201029481 | 8/2010 |
| WO | WO0073204 | 12/2000 |
| WO | WO2004012932 | 2/2004 |
| WO | WO2005102924 | 11/2005 |
| WO | WO2005120130 | 12/2005 |
| WO | WO2007043837 | 4/2007 |
| WO | WO2007049496 | 5/2007 |
| WO | WO2007052928 | 5/2007 |
| WO | WO2007099975 | 9/2007 |
| WO | W02007111107 | 10/2007 |
| WO | WO2008/029451 | 3/2008 |

OTHER PUBLICATIONS

Swift Gregory W., Thermoacoustic Engines and Refrigerators, Physics Today, Jul. 1995, pp. 22-28, vol. 48.

Kai Liu, Yinghui Sun, Lei Chen, Chen Feng, Xiaofeng Feng, Kaili Jiang et al., Controlled Growth of Super-Aligned Carbon Nanotube Arrays for Spinning Continuous Unidirectional Sheets with Tunable Physical Properties, Nano Letters, 2008, pp. 700-705, vol. 8, No. 2.
Yang Wei, Kaili Jiang, Xiaofeng Feng, Peng Liu et al., Comparative studies of multiwalled carbon nanotube sheets before and after shrinking, Physical Review B, Jul. 25, 2007, vol. 76, 045423.
Lina Zhang, Chen Feng, Zhuo Chen, Liang Liu et al., Superaligned Carbon Nanotube Grid for High Resolution Transmission Electron Microscopy of Nanomaterials, Nano Letters, 2008, pp. 2564-2569, vol. 8, No. 8.
Strutt John William, Rayleigh Baron, The Theory of Sound, 1926, pp. 226-235, vol. 2.
William Henry Preece, On Some Thermal Effects of Electric Currents, Proceedings of the Royal Society of London, 1879-1880, pp. 408-411, vol. 30.
Braun Ferdinand, Notiz uber Thermophonie, Ann. Der Physik, Apr. 1898, pp. 358-360,vol. 65.
H.D. Arnold, I.B. Crandall, The Thermophone as a Precision Source of Sound, Physical Review, 1917, pp. 22-38, vol. 10.
W. Yi, L.Lu, Zhang Dianlin et al., Linear Specific Heat of Carbon Nanotubes, Physical Review B, Apr. 1, 1999, vol. 59, No. 14, R9015-9018.
Frank P. Incropera, David P. Dewitt et al., Fundamentals of Heat and Mass Transfer, 6th ed., 2007, pp. A-5, Wiley:Asia.
Zhuangchun Wu, Zhihong Chen, Xu Du et al.,Transparent, Conductive Carbon Nanotube Films, Science, Aug. 27, 2004, pp. 1273-1276, vol. 305.
Kaili Jiang, Qunqing Li, Shoushan Fan, Spinning continuous carbon nanotube yarns, Nature, Oct. 24, 2002, pp. 801, vol. 419.
P. De Lange, On Thermophones, Proceedings of the Royal Society of London. Series A, Apr. 1, 1915, pp. 239-241, vol. 91, No. 628.
Mei Zhang, Shaoli Fang, Anvar A. Zakhidov, Sergey B. Lee et al., Strong, Transparent, Multifunctional, Carbon Nanotube Sheets, Science, Aug. 19, 2005, pp. 1215-1219, vol. 309.
Xiaobo Zhang, Kaili Jiang, Chen Feng, Peng Liu et al., Spinning and Processing Continuous Yarns from 4-Inch Wafer Scale Super-Aligned Carbon Nanotube Arrays, Advanced Materials, 2006, pp. 1505-1510, vol. 18.
Edward C. Wente, The Thermophone, Physical Review, 1922, pp. 333-345,vol. 19.
J.J.Hopfield, Spectra of Hydrogen, Nitrogen and Oxygen in the Extreme Ultraviolet, Physical Review, 1922, pp. 573-588,vol. 20.
Chen, Huxiong; Diebold, Gerald, "Chemical Generation of Acoustic Waves: A Giant Photoacoustic Effect", Nov. 10, 1995, Science, vol. 270, pp. 963-966.
Amos, S.W.; "Principles of Transistor Circuits"; 2000; Newnes-Butterworth-Heinemann; 9th ed.;p. 114.
Alexander Graham Bell, Selenium and the Photophone, Nature, Sep. 23, 1880, pp. 500-503.
Silvanus P. Thompson, The Photophone, Nature, 23, Sep. 1880, vol. XXII, No. 569, pp. 481.
Lee et al., Photosensitization of nonlinear scattering and photoacoustic emission from single-walled carbon nanotubes, Applied Physics Letters, Mar. 13, 2008, 92, 103122.
Lin Xiao et al., "Flexible, stretchable, transparent carbon nanotube thin film loudspeakers" vol. 8, No. 12, pp. 4539-4545 ,2008.

* cited by examiner

THERMOACOUSTIC DEVICE

CROSS-REFERENCE TO RELATED APPLICATIONS

This application claims all benefits accruing under 35 U.S.C. §119 from China Patent Application No. 200910106493.6, filed on Mar. 31, 2009 in the China Intellectual Property Office, and is a continuation-in-part of U.S. patent application Ser. No. 12/387,089, filed Apr. 28, 2009, entitled, "THERMOACOUSTIC DEVICE."

BACKGROUND

1. Technical Field

The present disclosure relates to acoustic devices, particularly, to a thermoacoustic device.

2. Description of Related Art

In a paper entitled "Flexible, Stretchable, Transparent Carbon Nanotube Thin Film Loudspeakers" by Jiang et al., Nano Letters, Oct. 29, 2008, Vol. 8 (12), 4539-4545, a loudspeaker is proposed. The loudspeaker adopts a carbon nanotube thin film as a sound emitter. Sound waves based on the thermoacoustic effect are generated by inputting an alternating current to sound emitter. The carbon nanotube thin film has a smaller heat capacity and a thinner thickness, so that it can transmit heat to surrounding medium rapidly. When the alternating current passes through the carbon nanotube thin film, oscillating temperature waves are produced in the carbon nanotube thin film. Heat waves excited by the alternating current are transmitted to the surrounding medium, causing thermal expansions and contractions of the surrounding medium, thus producing sound waves.

When the sound waves are generated by the carbon nanotube thin film, the carbon nanotube thin film projects heat waves in all directions. Consequently, other parts in the loudspeaker besides the sound emitter will absorb heat, and a temperature of the entire loudspeaker is elevated, lowering a capability of the loudspeaker.

What is needed, therefore, is to provide a thermoacoustic device having a lower temperature.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
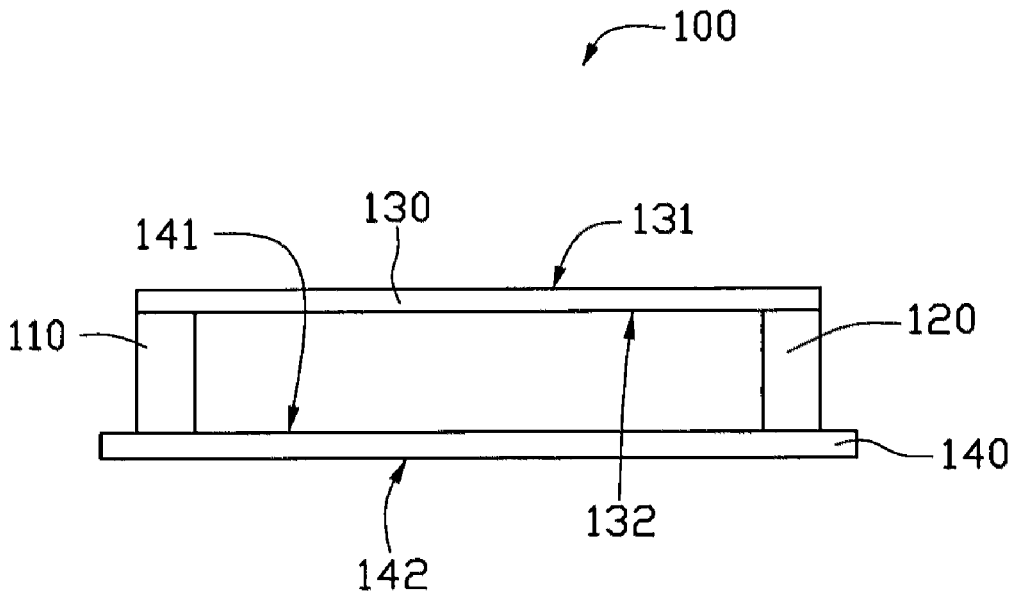
FIG. 1 is a schematic structural front view of a first embodiment of a thermoacoustic device having one first electrode and one second electrode.

Referring to FIG. 1, a first embodiment of a thermoacoustic device 100 includes a first electrode 110, a second electrode 120, a sound wave generator 130, and an infra-red reflecting element 140. The sound wave generator 130 has an upper surface 131 and a lower surface 132 facing the reflecting element 140. The sound wave generator 130 is electrically connected to the first and second electrodes 110, 120. The infra-red reflecting element 140 and the sound wave generator 130 are located on opposite sides of the first and second electrodes 110, 120. The infra-red reflecting element 140 and the sound wave generator 130 are kept electrically isolated.

The first electrode 110 and the second electrode 120 receive electrical signals and send the electrical signals to the sound wave generator 130. The sound wave generator 130 produces heat waves, according to the variation of the signals and/or signal strengths, that is transmitted to the surrounding medium. The heat waves cause thermal expansions and contractions of the surrounding medium, thus producing sound waves. The first electrode 110 and the second electrode 120 can be made of conductive material. The shape of the first electrode 110 or the second electrode 120 can be any shape such as lamellar, rod, wire, or block shaped. A material of the first electrode 110 or the second electrode 120 can be metals, conductive adhesives, carbon nanotubes, or indium tin oxides. In one embodiment, the first electrode 110 and the second electrode 120 are rod-shaped metal electrodes. The first electrode 110 and the second electrode 120 are electrically connected to two output terminals of the sound wave generator 130. The first electrode 110 and the second electrode 120 can also provide structural support for the sound wave generator 130. The first electrode 110 and the second electrode 120 are connected to the infra-red reflecting element 140. An insulating adhesive layer can be located between the sound wave generator 130 and each of the first electrode 110 and the second electrode 120 to insulate the sound wave generator 130 from the first electrode 110 and the second electrode 120.

Figure 2:
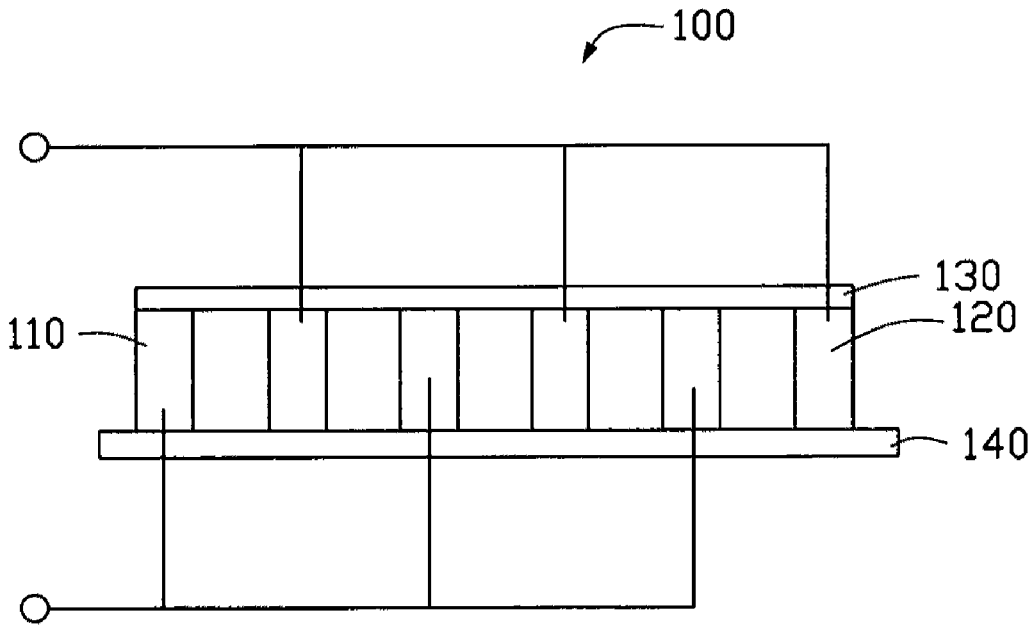
FIG. 2 is a schematic structural front view of the another embodiment of a thermoacoustic device having one more electrodes and one more second electrodes.

Referring to FIG. 2, the thermoacoustic device 100 can include additional first electrodes 110 and additional second electrodes 120. The first electrodes 110 and second electrodes 120 can be alternately spaced on the lower surface 132 of the sound wave generator 130. The first electrodes 110 are electrically connected in parallel to one terminal of a signal device generating electrical signals, and the second electrodes 120 are electrically connected in parallel to the other terminal of the signal device. The electric signals transferred from the signal device are conducted from the first electrodes 110 to the second electrodes 120.

The sound wave generator 130 can generate sound waves based on the thermoacoustic effect. The sound wave generator 130 has a large specific surface area and a heat capacity per unit area of less than $2\times10-4$ J/cm$^2$*K. In one embodiment, the sound wave generator 130 can have a heat capacity per unit area of less than or equal to about $1.7\times10^{-6}$ J/cm$^2$*K. The sound wave generator 130 can be a metal sheet, a carbon nanotube structure, or a combination of the two. In one embodiment, the sound wave generator 130 is a carbon nanotube structure. The sound wave generator 130 can be adhered directly to the first electrode 110 and the second electrode 120 and/or many other surfaces because the carbon nanotube structure has a large specific surface area. This will result in a good electrical contact between the sound wave generator 130 and the first and second electrodes 110, 120. Optionally, an adhesive can also be used.

The carbon nanotube structure can include a plurality of carbon nanotubes uniformly distributed therein, and can be combined by van der Waals attractive force therebetween. The carbon nanotubes in the carbon nanotube structure can be orderly or disorderly arranged. The term 'disordered carbon nanotube structure' includes a structure where the carbon nanotubes are arranged along many different directions, such that the number of carbon nanotubes arranged along each different direction can be almost the same (e.g. uniformly disordered), and/or entangled with each other. 'Ordered carbon nanotube structure' includes a structure where the carbon nanotubes are arranged in a consistently systematic manner, e.g., the carbon nanotubes are arranged approximately along a same direction and or have two or more sections within each of which the carbon nanotubes are arranged approximately along a same direction (different sections can have different directions). The carbon nanotubes in the carbon nanotube structure can be single-walled, double-walled, and/or multi-walled carbon nanotubes.

The carbon nanotube structure may have a substantially planar structure. The planar carbon nanotube structure can have a thickness of about 0.5 nanometers to about 1 millimeter. The smaller the heat capacity per unit area, the higher the sound pressure level of the thermoacoustic device 100.

The carbon nanotube structure may be a carbon nanotube film structure, a carbon nanotube linear structure, or combinations thereof. The thickness of the carbon nanotube structure can range from about 0.5 nanometers to about 1 millimeter.

Figure 3:
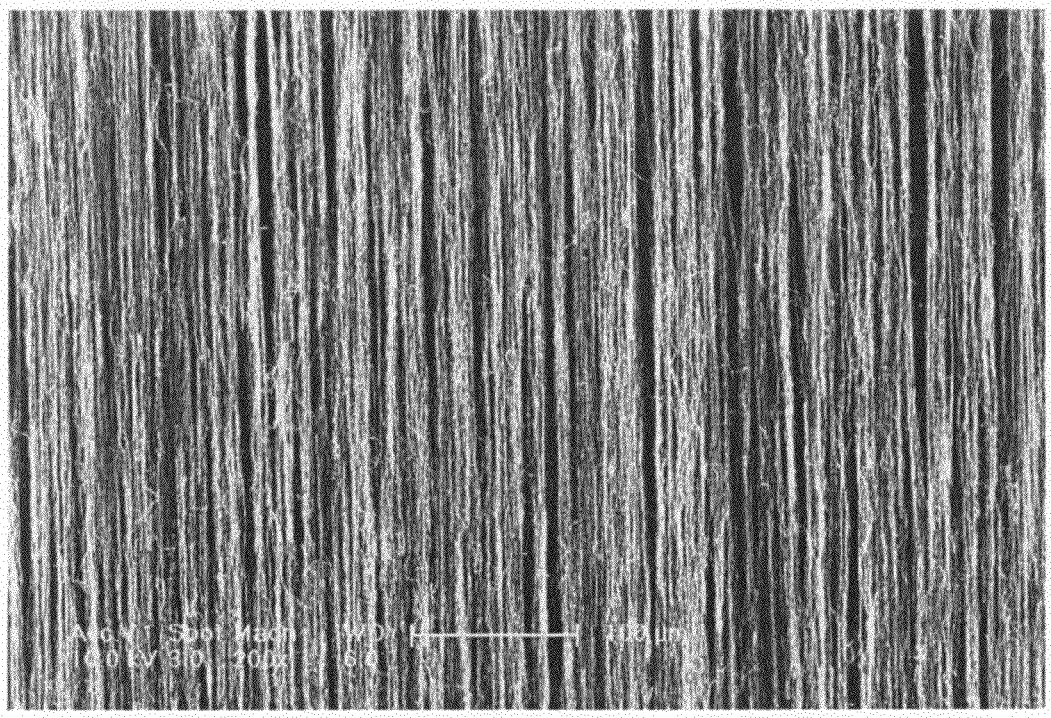
FIG. 3 shows a Scanning Electron Microscope (SEM) image of a carbon nanotube film.

In one embodiment, the carbon nanotube film structure can include at least one drawn carbon nanotube film as shown in FIG. 3. The drawn carbon nanotube film can include a plurality of successive and oriented carbon nanotubes joined end-to-end by van der Waals attractive force therebetween. The carbon nanotubes in the drawn carbon nanotube film can be substantially aligned in a single direction. Each drawn carbon nanotube film includes a plurality of successively oriented carbon nanotube segments joined end-to-end by van der Waals attractive force therebetween. Each carbon nanotube segment includes a plurality of carbon nanotubes substantially parallel to each other, and combined by van der Waals attractive force therebetween. Some variations can occur in the drawn carbon nanotube film. The carbon nanotubes in the drawn carbon nanotube film can also be oriented along a preferred orientation. The drawn carbon nanotube film can be formed by drawing a film from a carbon nanotube array that is capable of having a film drawn therefrom.

In one embodiment, the carbon nanotube film structure of the sound wave generator 130 includes a plurality of stacked drawn carbon nanotube films. The number of the layers of the drawn carbon nanotube films is not limited. However, a large enough specific surface area must be maintained to achieve an efficient thermoacoustic effect. The drawn carbon nanotube film has a thickness of about 0.5 nanometers to about 1 millimeter. An angle can exist between the carbon nanotubes in adjacent drawn carbon nanotube films. Adjacent drawn carbon nanotube films can be adhered by only the van der Waals attractive force therebetween. The angle between the aligned directions of the carbon nanotubes in the two adjacent drawn carbon nanotube films can range from 0 degrees to about 90 degrees. When the angle is larger than 0 degrees, the carbon nanotube film structure in an embodiment employing these films will have a plurality of micropores. The micropore structure will improve the structural integrity of the carbon nanotube film structure.

In one embodiment, the carbon nanotube linear structure can include carbon nanotube wires and/or carbon nanotube cables.

The carbon nanotube wire can be untwisted or twisted. The untwisted carbon nanotube wire includes a plurality of carbon nanotubes substantially oriented along a same direction (i.e., a direction along the length of the untwisted carbon nanotube wire). The carbon nanotubes are substantially parallel to the axis of the untwisted carbon nanotube wire. More specifically, the untwisted carbon nanotube wire includes a plurality of successive carbon nanotube segments joined end-to-end by van der Waals attractive force therebetween. Each carbon nanotube segment includes a plurality of carbon nanotubes substantially parallel to each other, and combined by van der Waals attractive force therebetween. The carbon nanotube segments can vary in width, thickness, uniformity and shape. A length of the untwisted carbon nanotube wire can be arbitrarily set as desired. A diameter of the untwisted carbon nanotube wire ranges from about 0.5 nanometers to about 100 micrometers. The twisted carbon nanotube wire includes a plurality of carbon nanotubes helically oriented around an axial direction of the twisted carbon nanotube wire. More specifically, the twisted carbon nanotube wire includes a plurality of successive carbon nanotube segments joined end-to-end by van der Waals attractive force therebetween. Each carbon nanotube segment includes a plurality of carbon nanotubes substantially parallel to each other, and combined by van der Waals attractive force therebetween. A length of the carbon nanotube wire can be set as desired. A diameter of the twisted carbon nanotube wire can be from about 0.5 nanometers to about 100 micrometers. Further, the twisted carbon nanotube wire can be treated with a volatile organic solvent after being twisted. After being soaked by the organic solvent, the adjacent paralleled carbon nanotubes in the twisted carbon nanotube wire will bundle together, due to the surface tension of the organic solvent as the organic solvent volatilizes. The specific surface area of the twisted carbon nanotube wire will decrease, while the density and strength of the twisted carbon nanotube wire will increase.

The carbon nanotube cable includes two or more carbon nanotube wires. The carbon nanotube wires in the carbon nanotube cable can be twisted or untwisted. In an untwisted carbon nanotube cable, the carbon nanotube wires are substantially parallel to each other. In a twisted carbon nanotube cable, the carbon nanotube wires are twisted with each other.

When the thermoacoustic device 100 is in operation, signals, such as, electrical signals, with variations in the application and/or strength are applied to the sound wave generator 130, thereby producing heat in the sound wave generator 130. A temperature of sound wave generator 130 will change rapidly because the sound wave generator 130 has a small heat capacity per unit area. Rapid thermal exchange can be achieved between sound wave generator 130 and the surrounding medium because the sound wave generator 130 has a large heat dissipation surface area. Therefore, according to the variations of the electrical signals, heat waves are propagated into surrounding medium rapidly. The heat waves will cause thermal expansion and contraction and change the density of the medium. The heat waves produce pressure waves in the surrounding medium, resulting in sound waves generation. In this process, it is the thermal expansion and contraction of the medium in the vicinity of the sound wave generator 130 that produces sound waves.

The infra-red reflecting element 140 is spaced from and facing the sound wave generator 130. The infra-red reflecting element 140 includes a top surface 141 and a bottom surface 142 at least partly opposite to the top surface 141. The top surface 141 faces the lower surface 132 of the sound wave generator 130. In one embodiment, the top surface 141 is substantially parallel to lower surface 132. A distance between the top surface 141 and the lower surface 132 can be longer than 100 microns, or a height of the first and second electrodes 110, 120 can be higher than 100 microns, to prevent the sound waves from being disturbed by the infra-red reflecting element 140. The top surface 141 acting as an infra-red reflecting surface of the infra-red reflecting element 140. The infra-red reflecting surface can be a flat surface, a curved surface, or a bendable surface. The lower surface 132 of the sound wave generator 130 can be a flat surface, a curved surface, or a bendable surface. An infrared reflection coefficient of the infra-red reflecting surface can be higher than 30 percent. An infrared radiation angle of the infra-red reflecting surface can be less than 180 degrees. Further, the infra-red reflecting surface can be a smooth surface having no apparent defects or holes thereon. In one embodiment, the infra-red reflecting surface is substantially parallel to the lower surface 132 of the sound wave generator 130. The area of the infra-red reflecting surface can be larger than the area of the lower surface 132. The infra-red reflecting element 140 can have a reflecting film thereon or be made of an infra-red reflecting material. The infra-red reflecting element 140 can be a heating reflecting panel made of a reflecting material. The reflecting material can be metal, metal compound, alloy, composite material, or combinations thereof. The metal can be chromium, zinc, aluminum, gold, silver, or combinations thereof. The alloy can be aluminum-zinc alloy. The composite material can be a paint including zinc oxide. An infra-red reflecting coefficient of the reflecting material can be higher than 30 percent to maintain a good reflective ability. For example, the infra-red reflecting coefficient of the heating reflecting panel made of the zinc can be higher than 38 percent. The infra-red reflecting coefficient of the heating reflecting panel made of the aluminum-zinc alloy can be higher than 75 percent. In one embodiment, there can be a plurality of spacers disposed between the infra-red reflecting element 140 and the sound wave generator 130. Each spacer has two opposite ends. One end of the spacer can be fixed to the infra-red reflecting element 140, the other end of the spacer can be connected or adhered to the sound wave generator 130, thereby supporting the sound wave generator 130.

The reflecting element 140 can be disposed at one side of the sound wave generator 130 to reflect the emitted heat of the sound wave generator 130 and reduce the temperature of the thermoacoustic device 100 on at least this one side. The thermoacoustic device 100 can also be designed to emit the heat directionally. Due to the reflecting surface, the infra-red reflecting element 140 can define a heat insulation space below the reflecting surface, thus a plurality of elements can be located in the heat insulation space to absorb less heat. Furthermore, the infra-red reflecting element 140 can also reflect the sound waves of the sound wave generator 130 thereby enhancing sound in at least one direction and enhancing an acoustic performance of the thermoacoustic device 100.

Figure 4:
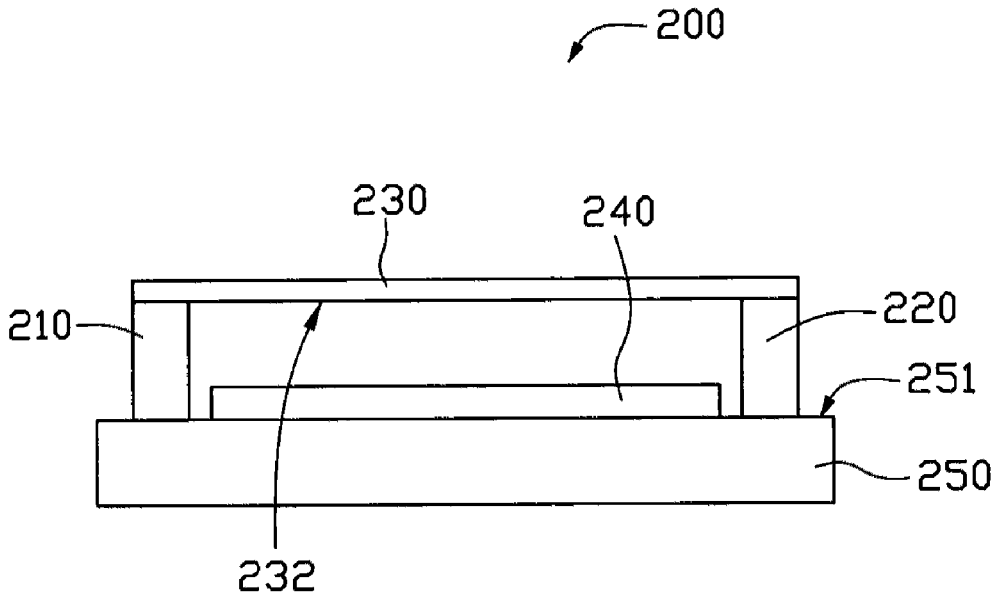
FIG. 4 is a schematic structural front view of a second embodiment of a thermoacoustic device.

Referring to FIG. 4, a thermoacoustic device 200 of one embodiment includes a first electrode 210, a second electrode 220, a sound wave generator 230 with a lower surface 232, an infra-red reflecting element 240, and a supporting element 250. The sound wave generator 230 is fixed to the supporting element 250 by the first electrode 210 and the second electrode 220. The infra-red reflecting element 240 and the sound wave generator 230 are located on opposite sides of the first and second electrodes 210, 220. The infra-red reflecting element 240 and the sound wave generator 230 are kept electrically insulated.

The compositions, features and functions of the thermoacoustic device 200 in the embodiment shown in FIG. 4 are similar to the thermoacoustic device 100 in the embodiment shown in FIG. 1 except that a supporting element 250 is employed. The sound wave generator 230 is spaced from and opposite to the supporting element 250.

The material of the supporting element 250 can be a rigid material, such as diamond, glass, or quartz, or a flexible material, such as plastic, resin, or fabric. The supporting element 250 can have a good strength to support the sound wave generator 230 and the electrodes 210, 220. The supporting element 250 can have a good electric insulating property to prevent the sound wave generator 230 from electrically connecting to the infra-red reflecting element 240. The supporting element 250 can be a planar structure with a loading surface 251 opposite to the lower surface 232 of the sound wave generator 230. In one embodiment, the loading surface 251 is a flat surface. The infra-red reflecting element 240 can be disposed on the loading surface 251. The infra-red reflecting element 240 can be an infra-red reflecting film adhered or coated on the loading surface 251. The area of the infra-red reflecting film can be smaller than the area of the sound wave generator 230, so that the infra-red reflecting film and the electrodes 210, 220 can be kept electrically insulated.

The supporting element 250 can absorb less heat because of the reflection of the infra-red reflecting element 240. If the thermoacoustic device 200 is fixed to other elements or buildings by the supporting element 250, the supporting element 250 can prevent the elements or buildings from being heated by the sound wave generator 230.

Figure 5:
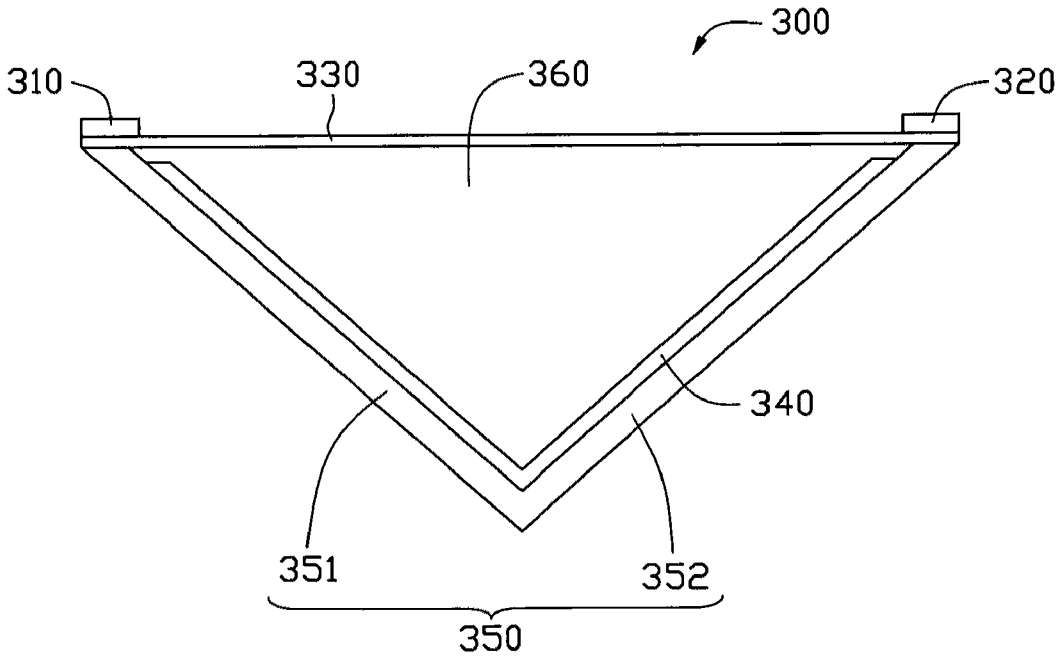
FIG. 5 is a schematic structural front view of a third embodiment of a thermoacoustic device.

Referring to FIG. 5, a thermoacoustic device 300 of one embodiment, includes a first electrode 310, a second electrode 320, a sound wave generator 330 electrically connected to the first and second electrodes 310, 320, an infra-red reflecting element 340 and a framing element 350. The framing element 350 includes a first supporting portion 351 and a second supporting portion 352 extending substantially perpendicularly from an end of the first supporting portion 351. The second supporting portion 352 has substantially the same length as that of the first supporting portion 351. The sound wave generator 330 is located on opposite free ends of the first and second supporting portions 351, 352 of the framing element 350, such that the sound wave generator 330 and the first and second supporting portions 352 substantially form an isosceles right triangle. A central portion of the sound wave generator 330 is suspended relative to the first and second supporting portions 351, 352 of the framing element 350. The first and second electrodes 310, 320 are located on opposite ends of the sound wave generator 330. The infra-red reflecting element 340 has a similar configuration as that of the framing element 350 and is adhered to an inner surface of the framing element 350. The infra-red reflecting element 340 and the sound wave generator 330 are located apart from each other. The infra-red reflecting element 340 and the sound wave generator 330 are kept electrically insulated.

Alternatively, the framing element 350 can have an L-shaped structure or a U-shaped structure, or any cavity structure with an opening. In one embodiment, the framing element 350 has an L-shaped structure. The sound wave generator 330 can cover the opening of the framing element 350 to form a Helmholtz resonator. The sound wave generator 330 extends from the distal end of the first supporting portion 351 to the distal end of the second supporting portion 352, resulting in a sound collection space 360. The sound collection space 360 can be defined by the sound wave generator 330 in cooperation with the L-shaped structure of the framing element 350. Sound waves generated by the sound wave generator 330 can be reflected by the infra-red reflecting element 340, thereby enhancing an acoustic performance of the thermoacoustic device 300. Alternatively, the thermoacoustic device 300 can have two or more framing elements 350 to collectively suspend the sound wave generator 330. A material of the framing element can be wood, plastics, metal and glass. Alternatively, a framing element can take any shape so that the sound wave generator 330 is suspended, even if no space is defined.

Figure 6:
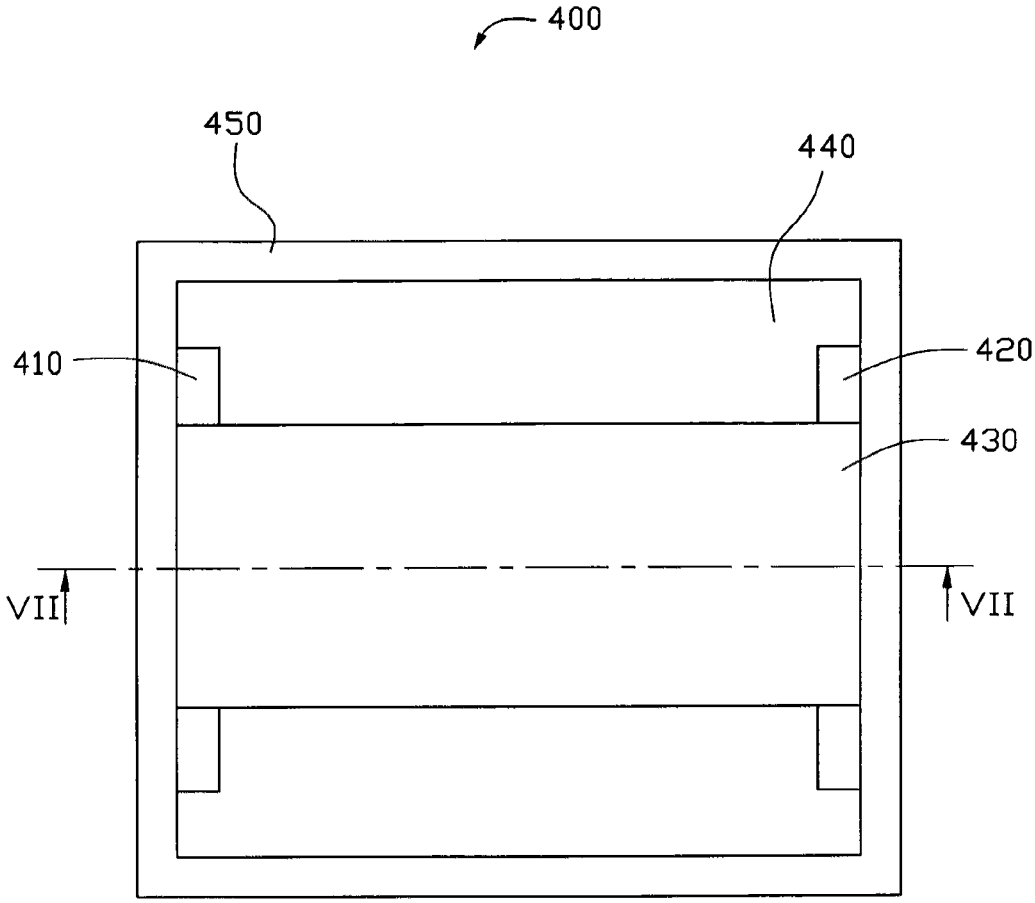
FIG. 6 is a schematic structural view of a fourth embodiment of a thermoacoustic device.
Figure 7:
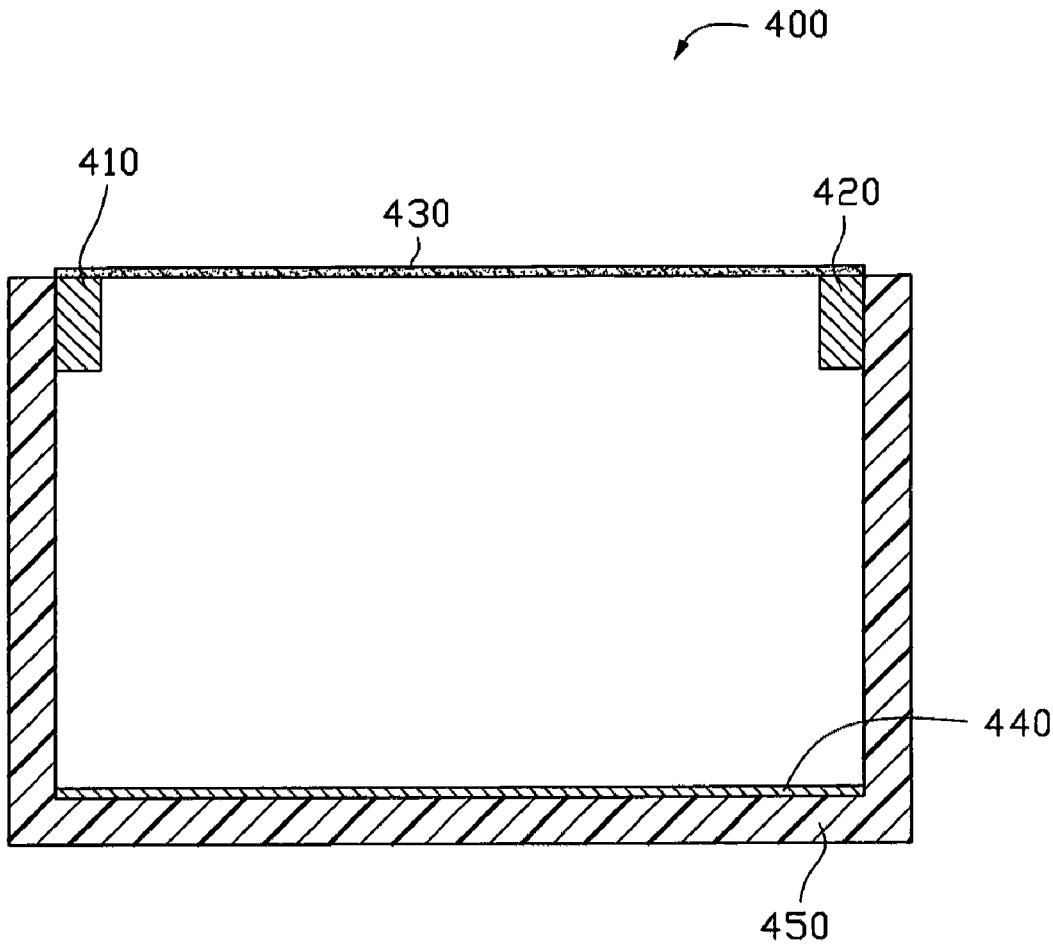
FIG. 7 is a cross-sectional view of the thermoacoustic device along a line VII-VII in FIG. 6.

Referring to FIG. 6 and FIG. 7, a thermoacoustic device 400 of one embodiment, includes a first electrode 410, a second electrode 420, a sound wave generator 430, an infra-red reflecting element 440 and a framing element 450. The sound wave generator 430 is fixed to the framing element 450 by the first electrode 410 and the second electrode 420. The sound wave generator 430 is located on one side of the first and second electrodes 410, 420 and electrically connected between them. The infra-red reflecting element 440 and the sound wave generator 430 are located on opposite sides of the first and second electrodes 410, 420. The infra-red reflecting element 440 is disposed on an inner surface of the framing element 450. The inner surface faces the sound wave generator 430. The infra-red reflecting element 440 and the sound wave generator 430 are kept electrically insulated.

The compositions, features, and functions of the thermoacoustic device 400 in the embodiment shown in FIG. 6 and FIG. 7 are similar to the thermoacoustic device 300 in the embodiment shown in FIG. 4 and FIG. 5. However, the framing element 450 can have a three dimensional structure, such as a cube, a cone, or a cylinder. In one embodiment, the framing element 450 is a cube with an opening.

Figure 8:
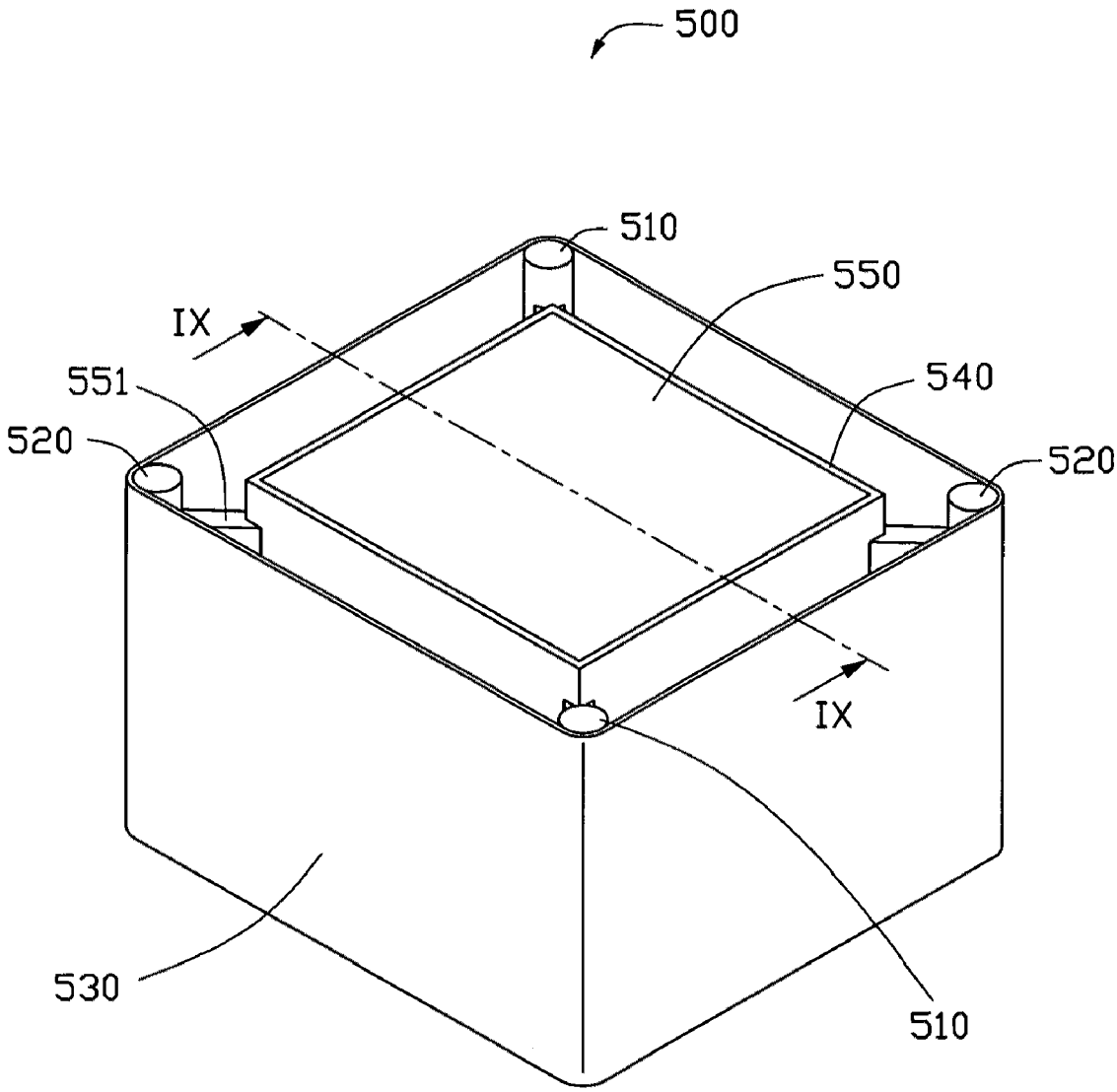
FIG. 8 is a schematic structural view of a fifth embodiment of a thermoacoustic device.
Figure 9:
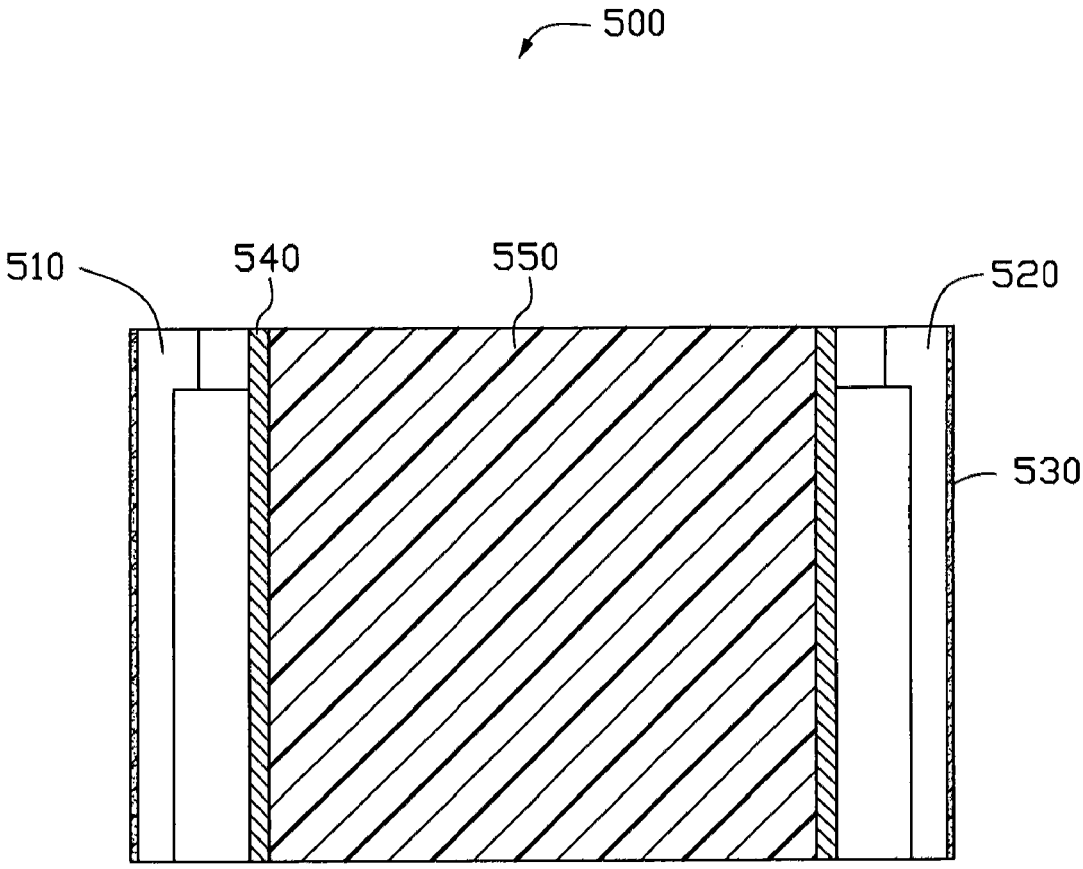
FIG. 9 is a schematic cross-sectional view of the thermoacoustic device in FIG. 8.

Referring to FIG. 8 and FIG. 9, a thermoacoustic device 500 of one embodiment, includes two or more first electrodes 510, two or more second electrodes 520, a sound wave generator 530, an infra-red reflecting element 540 and a supporting element 550. The sound wave generator 530 is supported by the first electrodes 510 and the second electrodes 520 and electrically connected between them. The infra-red reflecting element 540 and the sound wave generator 530 are located on opposite sides of the first and second electrodes 510, 520. The infra-red reflecting element 540 and the sound wave generator 530 are kept electrically insulated.

The compositions, features and functions of the thermoacoustic device 500 in the embodiment shown in FIG. 8 and FIG. 9 are similar to the thermoacoustic device 200 in the embodiment shown in FIG. 1. The thermoacoustic device 500 includes a plurality of first electrodes 510 and a plurality of second electrodes 520. The first electrodes 510 and the second electrodes 520 can be all rod-like metal electrodes located apart from each other. The first electrodes 510 and the second electrodes 520 can be in different planes. The sound wave generator 530, supported by the first and the electrodes 510, 520, can form a three dimensional structure. An inner surface of the sound wave generator 530 can be an annular surface. The three dimensional structure can define a receiving space for receiving the supporting element 550 and the infra-red reflecting element 540. The supporting element 550 can be a three dimensional structure concentric to the sound wave generator 530. The supporting element 550 can have a loading surface opposite and substantially parallel to the sound wave generator 530. The infra-red reflecting device 540 can be disposed on the loading surface and have an infra-red reflecting surface opposite to the inner surface of the sound wave generator 530. In one embodiment, the infra-red reflecting surface is concentric to the inner surface. Therefore, the infra-red reflecting device 540 can reflect the heat of the sound wave generator 530 to a direction far away from the supporting element 550. Furthermore, the supporting element 550 has a plurality of fixing arms 551 extending to the sound wave generator 530. The first electrodes 510 and the second electrodes 520 can be fixed to the supporting element 550 by the fixing arms 551. In one embodiment, the thermoacoustic device 500 includes two first electrodes 510 and two second electrodes 520. Each electrode is fixed to the supporting member by one fixing arm 551. As shown in FIG. 8, the first electrodes 510 and are electrically connected in parallel to one terminal of the sound wave generator 530. The second electrodes 520 are electrically connected in parallel to the other terminal of the sound wave generator 530. The parallel connections in the sound wave generator 530 provide a lower resistance. Thus, input voltage to the sound wave generator 530 can be lowered, thereby increasing a sound pressure of the thermoacoustic device 500. Further, a surrounding sound effect of the thermoacoustic device 500 can be achieved by the three dimensional structure of the sound wave generator 530. The sound wave generator 530, according to the present embodiment, can radiate thermal energy out to the surrounding medium, and thus create the sound wave. Alternatively, the first electrodes 510 and the second electrodes 520 can also be configured to and serve as a support for the sound wave generator 530.

Finally, it is to be understood that the above-described embodiments are intended to illustrate rather than limit the present disclosure. Variations may be made to the embodiments without departing from the spirit of the disclosure as claimed. Elements associated with any of the above embodiments are envisioned to be associated with any other embodiments. The above-described embodiments illustrate the scope but do not restrict the scope of the present disclosure.

What is claimed is:

1. A thermoacoustic device, comprising:

at least one first electrode;

at least one second electrode;

a sound wave generator electrically connected to the at least one first electrode and the at least one second electrode to receive a signal;

an infrared reflecting element having an infrared reflection coefficient higher than 30 percent and located at one side of the sound wave generator, the infrared reflecting element comprising an infrared reflecting surface facing to the sound wave generator, wherein the sound wave generator comprises a carbon nanotube film comprising a plurality of carbon nanotubes orderly arranged therein and joined end-to-end by the van der Waals attractive force therebetween;

wherein the infrared reflecting element and the sound wave generator are located apart from each other, the infrared reflecting surface and the sound wave generator define a heat insulation space; the sound wave generator is capable of converting signals into heat transferred to a surrounding medium.

2. The thermoacoustic device of claim 1, wherein the sound wave generator has a heat capacity per unit area of less than or equal to $2\times10^{-4}$ J/cm$^2$*K.

3. The thermoacoustic device of claim 1, wherein the infrared reflecting element has an infrared reflecting surface facing a surface of the sound wave generator.

4. The thermoacoustic device of claim 3, wherein the surface of the sound wave generator is substantially parallel to the infrared reflecting surface.

5. The thermoacoustic device of claim 3, wherein the surface of the sound wave generator is flat, and the infrared reflecting surface is curved or bendable.

6. The thermoacoustic device of claim 3, wherein an area of the surface of the sound wave generator is greater than that of the infra-red reflecting surface.

7. The thermoacoustic device of claim 1, further comprising a supporting element, wherein the sound wave generator is fixed on the supporting element.

8. The thermoacoustic device of claim 7, wherein a center portion of the sound wave generator is suspended.

9. The thermoacoustic device of claim 7, wherein the infrared reflecting element is located on a loading surface of the supporting element, and the loading surface is substantially parallel to a surface of the sound wave generator.

10. The thermoacoustic device of claim 9, wherein the surface of the sound wave generator is an annular surface, and the loading surface is concentric to the surface of the sound wave generator.

11. The thermoacoustic device of claim 7, wherein the supporting element comprises a cavity with an opening, wherein the sound wave generator covers the opening.

12. The thermoacoustic device of claim 1, wherein the infrared reflecting element is made of a material selected from the group consisting of metal, metal compound, alloy, composite material, and combinations thereof.

13. The thermoacoustic device of claim 12, wherein the metal is selected from the group consisting of chromium, zinc, aluminum, gold, silver, and combinations thereof; the alloy comprises aluminum-zinc alloy; the composite material comprises a paint including zinc oxide.

14. A thermoacoustic device, comprising:

a plurality of first electrodes electrically connected to each other;

a plurality of second electrodes electrically connected to each other, the first and second electrodes being alternately arranged;

a sound wave generator electrically connected to the first and second electrodes, the sound wave generator encircling the first and second electrodes to define a receiving space; and an infrared reflecting element received in the receiving space, the infrared reflecting element having an infrared reflecting surface facing the sound wave generator, the infrared reflecting element defining a heat insulation space at a side of the infrared reflecting surface facing the sound wave generator, and an infrared reflection coefficient of the infrared reflecting surface being higher than 30 percent.

15. A thermoacoustic device, comprising:

at least one first electrode;

at least one second electrode;

a sound wave generator electrically connected to the at least one first electrode and the at least one second electrode, the sound wave generator having a lower surface; and an infrared reflecting element having an infrared reflecting surface located at one side of the sound wave generator, the infrared reflecting surface being adjacent to the lower surface and capable of reflecting higher than 30 percent infrared emitted from the side.

16. The thermoacoustic device of claim 15, wherein a heat insulation space is defined below the infrared reflecting surface.

17. The thermoacoustic device of claim 15, wherein a distance between the lower surface and the infrared reflecting surface is greater than 100 microns.

18. The thermoacoustic device of claim 1, wherein a distance between the-infrared reflecting element and the sound wave generator is greater than or equal to 100 microns.

19. The thermoacoustic device of claim 15, wherein the lower surface is flat, and the infrared reflecting surface is curved or bendable.

* * * * *